US006494417B1

(12) United States Patent
Gizzi

(10) Patent No.: US 6,494,417 B1
(45) Date of Patent: Dec. 17, 2002

(54) PAINT CAN AND ROLLER TRAY BRUSH HOLDER

(76) Inventor: Eugene A. Gizzi, 6815 Sunderland Dr., Cleveland, OH (US) 44129

( * ) Notice: Subject to any disclaimer, the term of this patent is extended or adjusted under 35 U.S.C. 154(b) by 0 days.

(21) Appl. No.: 09/824,697

(22) Filed: Apr. 4, 2001

(51) Int. Cl.[7] ..... A46B 17/02

(52) U.S. Cl. ..... 248/110; 248/113; 220/696; 220/697

(58) Field of Search ..... 248/110, 113, 248/111, 112; 220/695, 696, 697, 698

(56) References Cited

U.S. PATENT DOCUMENTS

| | | | | | |
|---|---|---|---|---|---|
| 2,542,737 | A | * | 2/1951 | Vogel | 220/90 |
| 2,803,374 | A | * | 8/1957 | Cash | 220/90 |
| 3,948,413 | A | * | 4/1976 | Gorrell et al. | 220/90 |
| 4,010,866 | A | | 3/1977 | McClane | 220/570 |
| 4,014,453 | A | * | 3/1977 | Tarnacki | 220/90 |
| 4,101,046 | A | * | 7/1978 | Puntillo | 220/90 |
| 4,266,746 | A | | 5/1981 | Klaiber | 248/113 |
| 4,275,818 | A | | 6/1981 | Church | 220/90 |
| 4,832,293 | A | | 5/1989 | Gizzi | 248/110 |
| 4,949,864 | A | * | 8/1990 | LaKier | 220/90 |
| 4,951,857 | A | | 8/1990 | Carr | 224/230 |
| 5,038,955 | A | | 8/1991 | Studer | 220/90 |
| 5,375,736 | A | * | 12/1994 | Gonzalez et al. | 220/697 |
| 5,853,157 | A | | 12/1998 | O'Donnell | 248/213.2 |

* cited by examiner

*Primary Examiner*—Anita King
*Assistant Examiner*—Steven Marsh
(74) *Attorney, Agent, or Firm*—Alvin S. Blum

(57) ABSTRACT

An accessory removably snaps onto the upstanding edge of a roller tray or the bail of a can holding paint and the like. It has a hook to hold a brush by a hole in the brush handle when the brush is not in use. A wide scraping or wiping blade at the lower end causes excess fluid removed from the brush to drain into the can or tray. The accessory is equipped with a carrying handle for lifting the can by its bail.

4 Claims, 3 Drawing Sheets

1
2
3
4
5
6
9
10
11
13
20
21
22
23
24
25
26

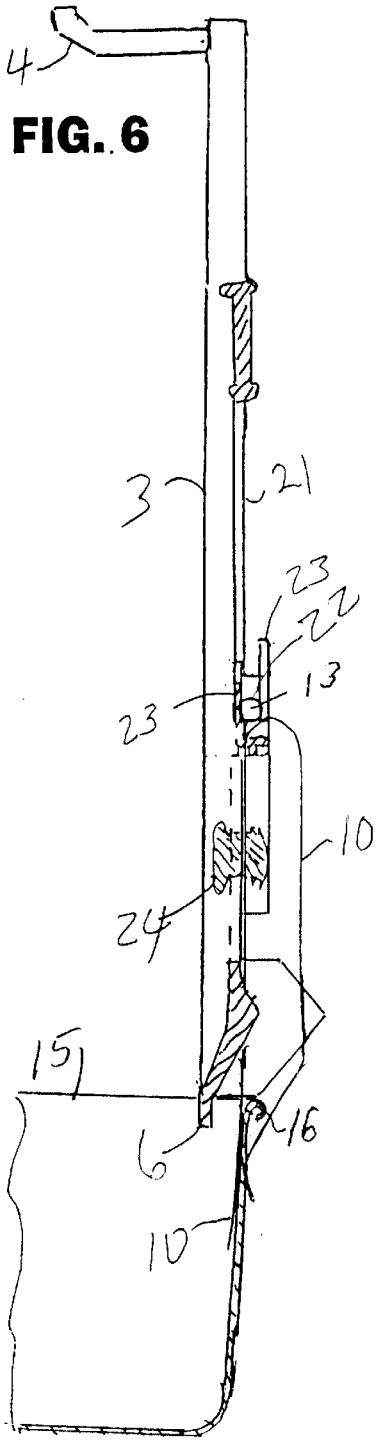
FIG. 6
FIG. 5
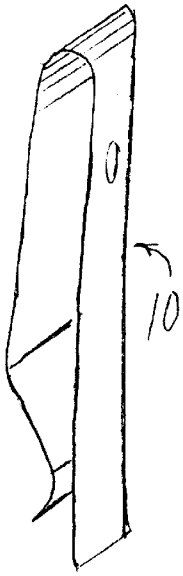
FIG. 8
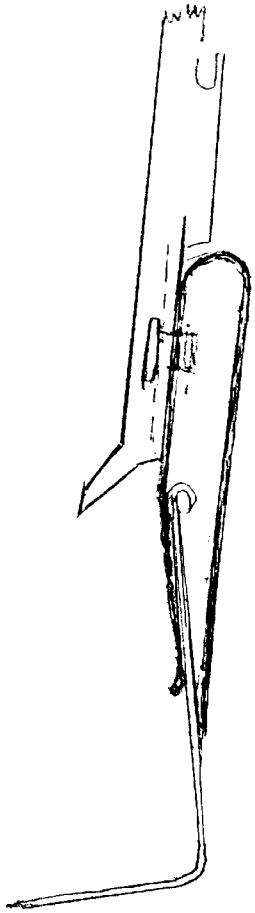
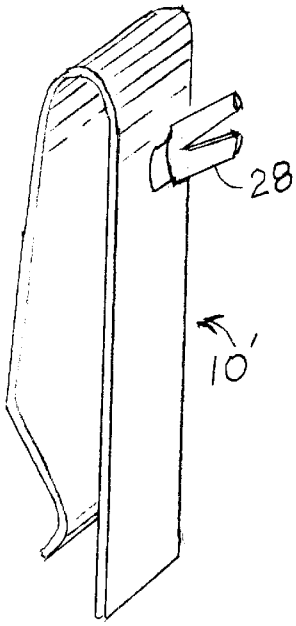
FIG. 7

PAINT CAN AND ROLLER TRAY BRUSH HOLDER

FIELD OF THE INVENTION

This invention relates to apparatus for conveniently holding a paint brush and more particularly for a paint brush holder that can be removably attached to a paint can and/or a roller tray.

BACKGROUND OF THE INVENTION

When painting with a brush from a can that has a bail, one must often move about while carrying both the can and the wet brush. This requires two hands, and the brush may drip.

U.S. Pat. No. 4,832,293 issued May 23, 1989 to Applicant discloses a brush holder that fits on the bail of a paint can and provides a clean can carrying means as well as a wiping edge for removing excess paint from the bristles. The device cannot be used with a roller tray.

When painting with a roller from a tray, one often needs a brush for fine work. If this is simply put into the tray when not in use, the handle may become wet.

U.S. Pat. No. 4,010,866 issued Mar. 8, 1977 to McClane discloses a special roller pan or tray to hold a brush upright. U.S. Pat. No. 5,853,157 issued Dec. 29, 1998 to O'Donnell discloses a one piece molded brush holder that can clip onto an edge of a paint can or a roller tray, but cannot be used to carry the can. U.S. Pat. No. 4,266,746 issued May 12, 1981 to Klaiber discloses a brush holder that fastens to a band that has been clamped around a paint can or to the upstanding edge of a roller tray. The band may not easily fit on all cans and it carries its own bail. It cannot be easily transferred between containers. It would be useful to provide a brush holder that has a wiping edge, a clean carrying handle that allows a paint can to pivot on its bail, and that can be easily transferred between cans and to also snap onto the upstanding edge of a roller tray.

SUMMARY OF THE INVENTION

It is accordingly an object of the invention to provide a brush holder that will easily snap onto and off of the bail of a can and the upstanding edge of a roller tray that hold paint or other fluids. The front face of the brush holder of the invention has an upper hook for passing through a hole in the handle of the brush. This conveniently holds the brush with bristles down so fluid drains down into the can or tray and that it is readily removed for use. The brush holder has at the lower end a wide scraping or wiping element that enables excess fluid to be removed from the brush and to drain into the tray or can. The rear face of the holder is provided with two spring biased attachment means for removably attaching to either the bail of a paint can or the upstanding edge of a roller tray.

These and other objects, features, and advantages of the invention will become more apparent when the detailed description is studied in conjunction with the drawings in which like elements are designated by like reference characters in the various drawing figures.

BRIEF DESCRIPTION OF THE DRAWINGS

FIG. 5 is a perspective view of the metal spring clip of the invention.

FIG. 6 is a cross sectional view as in FIG. 3 mounted on a roller tray.

FIG. 7 is a perspective view of a molded plastic spring clip of another embodiment of the invention.

FIG. 8 is a cross sectional view as in FIG. 6 of another embodiment of the invention.

DETAILED DESCRIPTION OF PREFERRED EMBODIMENTS

Figure 4:
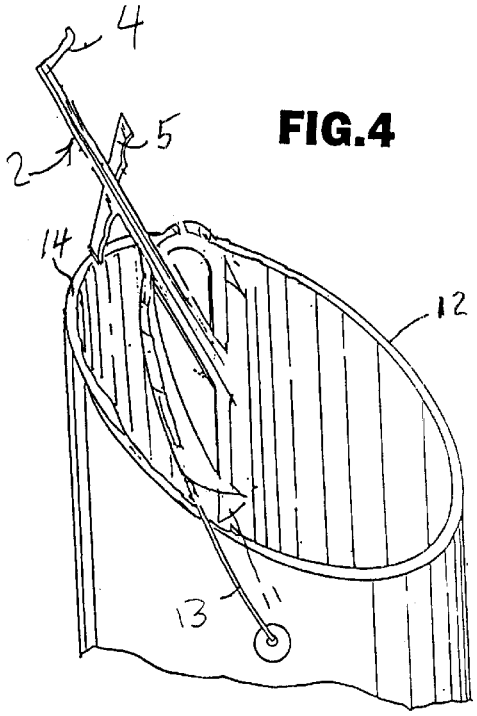
FIG. 4 is a perspective view of the invention mounted on the bail of a paint can.
Figure 1:
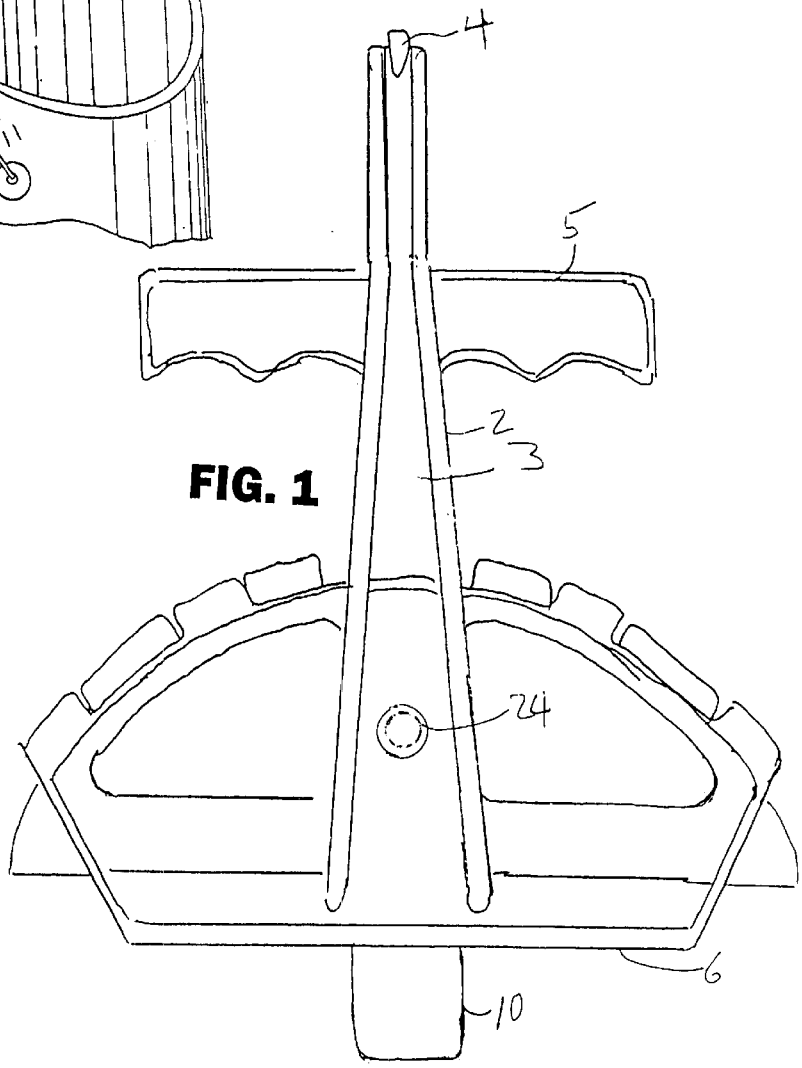
FIG. 1 is a front elevation view of the invention.
Figures 2, 3:
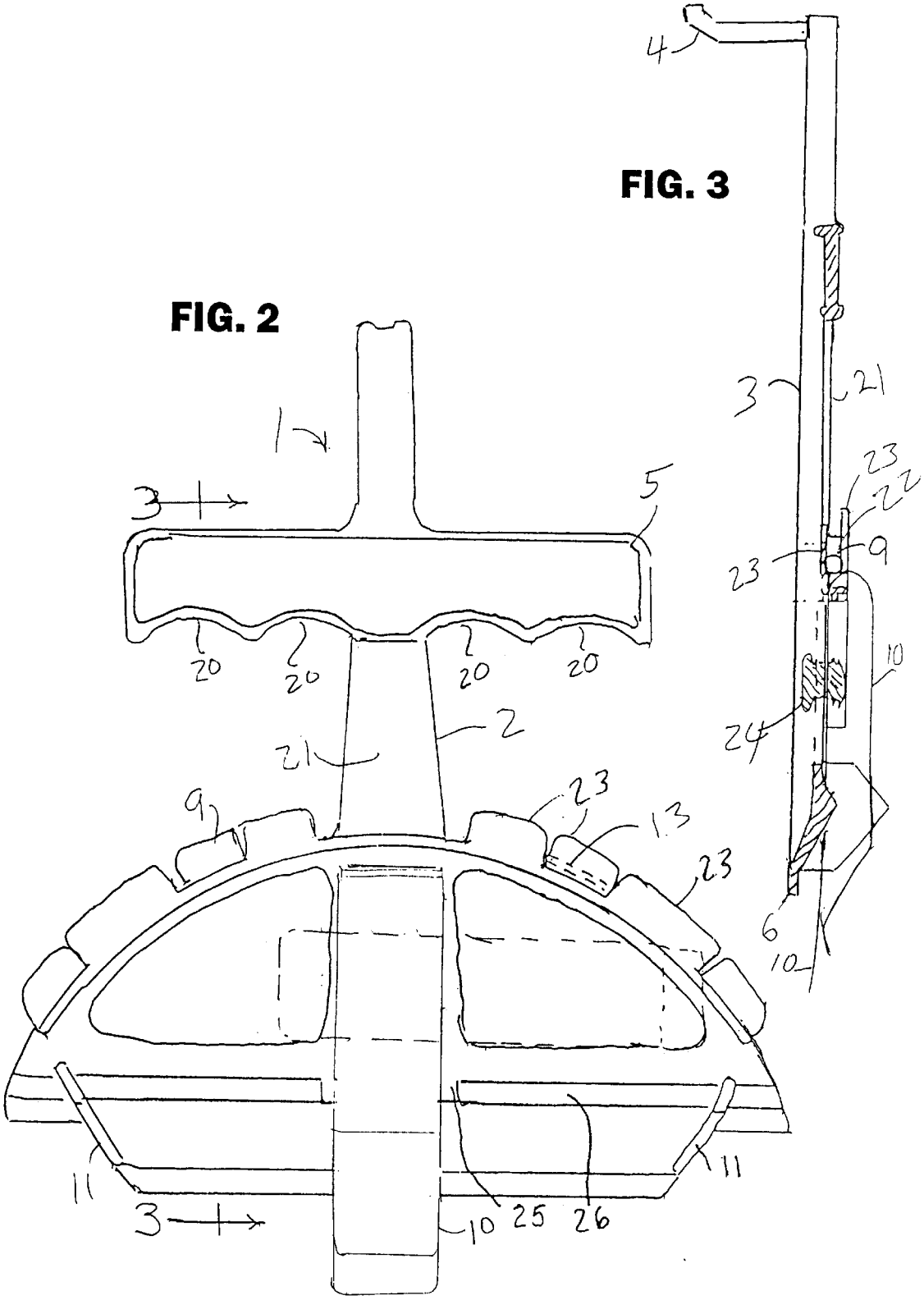
FIG. 2 is a rear view of the invention.
FIG. 3 sectional view through line 3—3 of FIG. 2.

Referring now first to drawing FIGS. 1–6, the accessory 1 of the invention has a rigid body 2; a front face 3; an opposed rear face 21; a hook 4 at the upper portion for engaging a hole in the handle of a brush; and a carrying handle 5 provided with indentations 20 for the fingers. A wide wiping blade 6 for wiping excess fluid from the brush positioned at a lowest portion of the body allows the wiped fluid to drain into the container. A springy bail engaging means 9 includes an arcuate groove 22 defined by tabs 23 upstanding from opposite sides of the groove that grip the bail 13 of a can 12. With this arrangement, the brush will be securely hung from hook 4 while the can is lifted by handle 5. The pivoting bail keeps the heavy can nicely balanced while carrying the brush and can with one hand by handle 5. When not being carried, the brush may be removed and the accessory tilted back out of the way as best seen in FIG. 4. Angle limiting means 11 rests on the top surface 14 of the container 12 to maintain the tilt angle. Springy clip 10 is pivotally mounted to the body by fastener 24. It may be rotated 90 degrees to the position shown in phantom when not in use. Gap 25 in ridge 26 acts like a detent to maintain the position of clip 10 for use as shown in FIG. 6 when it is clipped onto the upstanding edge 16 of a paint roller tray 15. Fastener 24 may optionally be removable if it is desired to work without clip 10.

Referring now to FIG. 7, another embodiment of the spring clip 10' has a molded-on split fastener 28 which snaps into the hole in the body 2. The entire clip 10' may be molded in one piece of plastic.

Referring now to FIG. 8, another embodiment of the invention shows the spring clip creating a tilt of the brush holder when mounted on the pan for more secure brush holding.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. An accessory for holding a paint brush that has a hole in the handle for use with both a paint roller tray having an upstanding edge and a paint can having a pivotally mounted carrying bail, the accessory comprising:

a) a body having a front face, a rear face, and a carrying handle;

b) a brush-engaging hook at an upper portion of the front face for cooperating with the hole in the handle;

c) a wide brush wiping means at a lower portion of the front face disposed to drain excess fluid therefrom into the can;

d) a springy bail engaging means connected to the rear face constructed for removably attaching the accessory to the bail, thereby enabling the accessory to pivot from a first, tilted position, to a second, balanced upright carrying position for carrying the can by the carrying handle;

e) a springy clip connected to a lower portion of the rear face constructed for removably attaching to the upstanding edge of the roller tray, and in which the springy clip is rotatably connected to the body for rotation through ninety degrees between a deployed position and a retracted position.

2. The accessory according to claim 1, in which the springy clip is removably connected to the body.

3. The accessory according to claim 2, in which the springy clip is a bent metal strip.

4. The accessory according to claim 2, in which the springy clip is a molded plastic element.

* * * * *